US007519530B2

(12) United States Patent
Kaajas et al.

(10) Patent No.: US 7,519,530 B2
(45) Date of Patent: Apr. 14, 2009

(54) AUDIO SIGNAL PROCESSING

(75) Inventors: Samu Kaajas, Espoo (FI); Sakari Värilä, Espoo (FI)

(73) Assignee: Nokia Corporation, Espoo (FI)

( * ) Notice: Subject to any disclaimer, the term of this patent is extended or adjusted under 35 U.S.C. 154(b) by 1073 days.

(21) Appl. No.: 10/338,890

(22) Filed: Jan. 9, 2003

(65) Prior Publication Data

US 2004/0138874 A1 Jul. 15, 2004

(51) Int. Cl.
*G10L 19/14* (2006.01)

(52) U.S. Cl. ..... 704/205; 704/500

(58) Field of Classification Search ..... 704/200.1, 704/205, 270, 500–504, 201
See application file for complete search history.

(56) References Cited

U.S. PATENT DOCUMENTS 5,455,888 A 10/1995 Iyengar et al.
5,581,652 A 12/1996 Abe et al.
5,978,759 A 11/1999 Tsushima et al.
6,072,877 A 6/2000 Abel
6,178,245 B1 1/2001 Starkey et al.
6,215,879 B1 * 4/2001 Dempsey ..... 381/61
6,421,446 B1 7/2002 Cashion et al.
6,704,711 B2 * 3/2004 Gustafsson et al. ..... 704/258
2003/0050786 A1 * 3/2003 Jax et al. ..... 704/500
2005/0187759 A1 * 8/2005 Malah et al. ..... 704/200

FOREIGN PATENT DOCUMENTS

CN 1190773 A 8/1998
WO WO 00/67502 11/2000
WO WO 01/91111 A1 11/2001

* cited by examiner

*Primary Examiner*—Angela A Armstrong
(74) *Attorney, Agent, or Firm*—Squire, Sanders & Dempsey L.L.P.

(57) ABSTRACT

A processor for processing an audio signal can have a receiving unit configured to receive an audio signal, an expansion unit configured to expand a bandwidth of the audio signal, and a processing unit configured to process the audio signal having an expanded bandwidth for spatial reproduction.

27 Claims, 1 Drawing Sheet

AUDIO SIGNAL PROCESSING

BACKGROUND OF THE INVENTION

Field of the Invention

The invention relates to processing an audio signal.

Spatial processing, also known as 3D audio processing, applies various processing techniques in order to create a virtual sound source (or sources) that appears to be in a certain position in the space around a listener. Spatial processing can take one or many monophonic sound streams as input and produce a stereophonic (two-channel) output sound stream that can be reproduced using headphones or loudspeakers, for example. Typical spatial processing includes the generation of interaural time and level differences (ITD and ILD) to output signal caused by head geometry. Spectral cues caused by human pinnae are also important because the human auditory system uses this information to determine whether the sound source is in front of or behind the listener. The elevation of the source can also be determined from the spectral cues.

Spatial processing has been widely used in e.g. various home entertainment systems, such as game systems and home audio systems. In telecommunication systems, such as mobile telecommunications systems, spatial processing can be used e.g. for virtual mobile teleconferencing applications or for monitoring and controlling purposes. An example of such a system is presented in WO 00/67502.

In a typical mobile communications system the audio (e.g. speech) signal is sampled at a relatively low frequency, e.g. 8 kHz, and subsequently coded with a speech codec. As a result, the regenerated audio signal is bandlimited by the sampling rate. If the sampling frequency is e.g. 8 kHz, the resulting signal does not contain information above 4 kHz.

The lack of high frequencies in the audio signal, in turn, is a problem if spatial processing is to be applied to the signal. This is due to the fact that a person listening to a sound source needs a signal content of a high frequency (the frequency range above 4 kHz) to be able to distinguish whether the source is in front of or behind him/her. High frequency information is also required to perceive sound source elevation from 0 degree level. Thus, if the audio signal is limited to frequencies below 4 kHz, for example, it is difficult or impossible to produce a spatial effect on the audio signal.

One solution to the above problem is to use a higher sampling rate when the audio signal is sampled and thus increase the high frequency content of the signal. Applying higher sampling rates in telecommunications systems is not, however, always feasible because it results in much higher data rates with increased processing and memory load and it may also require designing a new set of speech coders, for example.

BRIEF DESCRIPTION OF THE INVENTION

An object of the present invention is thus to provide a method and an apparatus for implementing the method so as to overcome the above problem or to at least alleviate the above disadvantages.

The object of the invention is achieved by providing a method for processing an audio signal, the method comprising receiving an audio signal having a narrow bandwidth; expanding the bandwidth of the audio signal; and processing the expanded bandwidth audio signal for spatial reproduction.

The object of the invention is also achieved by providing an arrangement for processing an audio signal, the arrangement comprising means for expanding the bandwidth of an audio signal having a narrow bandwidth; and means for processing the expanded bandwidth audio signal for spatial reproduction.

Furthermore, the object of the invention is achieved by providing an arrangement for processing an audio signal, the arrangement comprising bandwidth expansion means configured to expand the bandwidth of an audio signal having a narrow bandwidth; and spatial processing means configured to process the expanded bandwidth audio signal for spatial reproduction.

The invention is based on an idea of enhancing spatial processing of a low-bandwidth audio signal by artificially expanding the bandwidth of the signal, i.e. by creating a signal with higher bandwidth, before the spatial processing.

An advantage of the method and arrangement of the invention is that the proposed method and arrangement are readily compatible with existing telecommunications systems, thereby enabling the introduction of high quality spatial processing to current low-bandwidth systems with only relatively minor modifications and, consequently, low cost.

Further scope of applicability of the present invention will become apparent from the detailed description given hereinafter.

BRIEF DESCRIPTION OF THE DRAWINGS

In the following the invention will be described in greater detail by means of preferred embodiments with reference to the attached drawings, in which.

DETAILED DESCRIPTION OF THE INVENTION

In the following the invention is described in connection with a telecommunications system, such as a mobile telecommunications system. The invention is not, however, limited to any particular system but can be used in various telecommunications, entertainment and other systems, whether digital or analogue. A person skilled in the art can apply the instructions to other systems containing corresponding characteristics.

Figure 1:
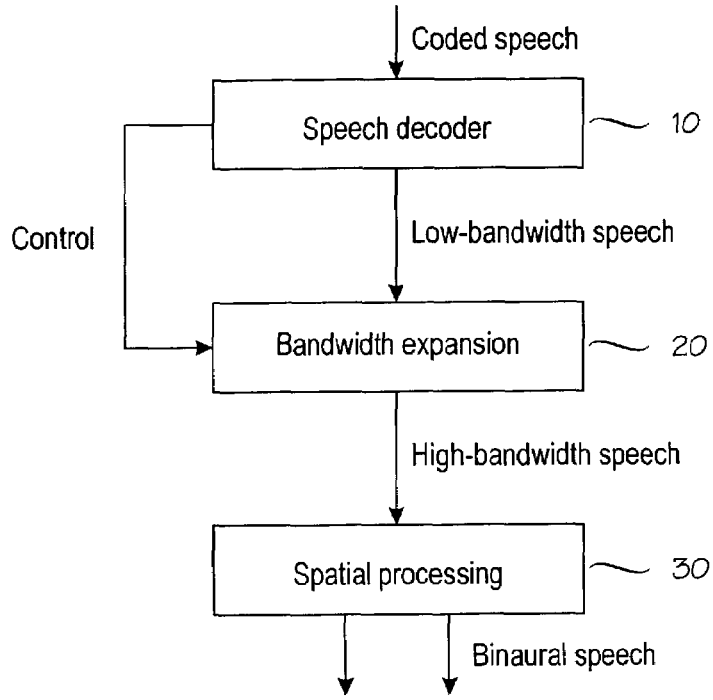
FIG. 1 is a block diagram of a signal processing arrangement according to an embodiment of the invention.

FIG. 1 illustrates a block diagram of a signal processing arrangement according to an embodiment of the invention. It should be noted that the figures only show elements that are necessary for the understanding of the invention. The detailed structure and functions of the system elements are not shown in detail, because they are considered obvious to a person skilled in the art. According to the invention, a low-bandwidth (or narrow bandwidth) audio signal, e.g. speech signal, is first processed in order to expand the bandwidth of the audio signal; this takes place in a bandwidth expansion block 20. The obtained high-bandwidth (or expanded bandwidth) audio signal is then further processed for spatial reproduction; this takes place in a spatial processing block 30, which preferably produces a stereophonic binaural audio signal. The low-bandwidth audio signal can be obtained e.g. from a transmission path of a telecommunications system via an audio decoder, such as a speech decoder 10, if the audio signal is transmitted in a coded form. However, the source of the low-bandwidth audio signal received at block 20 is not relevant to the basic idea of the invention. Furthermore, the terms 'low-bandwidth' or 'narrow bandwidth' and 'high-bandwidth' or 'expanded bandwidth' should be understood as descriptive and not limited to any exact frequency values. Generally the terms 'low-bandwidth' or 'narrow bandwidth' refer approximately to frequencies below 4 kHz and the terms 'high-bandwidth' or 'expanded bandwidth' refer approximately to frequencies over 4 kHz. The invention and the blocks 10, 20 and 30 can be implemented by a digital signal processing equipment, such as a general purpose digital signal processor (DSP), with suitable software therein, for example. It is also possible to use a specific integrated circuit or circuits, or corresponding devices.

The input for the speech decoder 10 is typically a coded speech bitstream. Typical speech coders in telecommunication systems are based on the linear predictive coding (LPC) model. In LPC-based speech coding the voiced speech is modeled by filtering excitation pulses with a linear prediction filter. Noise is used as the excitation for unvoiced speech. Popular CELP (Codebook Excited Linear Prediction) and ACELP (Algebraic Codebook Excited Linear Prediction)-coders are variations of this basic scheme in which the excitation pulse(s) is calculated using a codebook that may have a special structure. Codebook and filter coefficient parameters are transmitted to the decoder in a telecommunication system. The decoder 10 synthesizes the speech signal by filtering the excitation with an LPC filter. Some of the more recent speech coding systems also exploit the fact that one speech frame seldom consists of purely voiced or unvoiced speech but more often of a mixture of both. Thus, it is purposeful to make separate voiced/unvoiced decisions for different frequency bands and that way increase the coding gain. MBE (Multi-Band Excitation) and MELP (Mixed Excitation Linear Prediction) use this approach. On the other hand, codecs using Sinusoidal or WI (Waveform Interpolation) techniques are based on more general views on the information theory and the classic speech coding model with voiced/unvoiced decisions is not necessarily included in those as such. Regardless of the speech coder used, the resulting regenerated speech signal is bandlimited by the original sampling rate (typically 8 kHz) and by the modeling process itself. The lowpass style spectrum of voiced phonemes usually contains a clear set of resonances generated by the all-pole linear prediction filter. The spectrum for unvoiced speech has a high-pass nature and contains typically more energy in the higher frequencies.

The purpose of the bandwidth expansion block 20 is to artificially create a frequency content on the frequency band (approximately >4 kHz) that does not contain any information and thus enhance the spatial positioning accuracy. Studies show that higher frequency bands are important in front/back and up/down sound localization. It seems that frequency bands around 6 kHz and 8 kHz are important for up/down localization, while 10 kHz and 12 kHz bands for front/back localization. It must be noted that the results depend on subject, but as a general conclusion it can be said that the frequency range of 4 to 10 kHz is important to the human auditory system when it determines sound location. If the bandwidth expansion block 20 is designed to boost these frequency bands, for example 6 kHz and 8 kHz, it is likely that the up/down accuracy of spatial sound source positioning can be increased for an originally bandlimited signal (for example a coded speech that is bandlimited to below 4 kHz).

The bandwidth expansion block 20 can be implemented by using a so-called AWB (Artificial WideBand) technique. The AWB concept is originally developed for enhancing the reproduction of unvoiced sounds after low bit rate speech coding and although there are various methods available the invention is not restricted to any specific one. Many AWB techniques rely on the correlation between low and high frequency bands and use some kind of codebook or other mapping technique to create the upper band with the help of an already existing lower one. It is also possible to combine intelligent aliasing filter solutions with a common upsampling filter. Examples of suitable AWB techniques that can be used in the implementation of the present invention are disclosed in U.S. Pat. Nos. 5,455,888, 5,581,652 and 5,978,759, incorporated herein as a reference. The only possible restriction is that the bandwidth expansion algorithm should preferably be controllable, because it is recommended to process unvoiced and voiced speech differently, therefore some kind of knowledge about the current phoneme class must be available. In the embodiment of the invention shown in FIG. 1, the control information is provided by the speech decoder 10. It is also useful for optimal speech quality that the expansion method is tunable to various speech codecs and spatial processing algorithms. However this property is not necessary. Output from the expansion block 20 is preferably an audio signal with artificially generated frequency content in frequencies above half the original sampling rate (Nyquist frequency). It should be noted that if the invention is realized with a digital signal processing apparatus and the signals are digital signals, the output signal has a higher sampling rate than the low-bandwidth input signal.

The spatial processing block 30 can apply various processing techniques to create a virtual sound source (or sources) that appears to be in a certain position around a listener. The spatial processing block 30 can take one or several monophonic sound streams as an input and it preferably produces one stereophonic (two-channel) output sound stream that can be reproduced using either headphones or loudspeakers, for example. More than two channels can also be used. When creating virtual sound sources, the spatial processing 30 preferably tries to generate three main cues for the audio signal. These cues are: 1) Interaural time difference (ITD) caused by the different length of the audio path to the listener's left and right ear, 2) Interaural level difference (ILD) caused by the shadowing effect of the head, and 3) signal spectrum reshaping caused by the human head, torso and pinnae. The spectral cues caused by human pinnae are important because the human auditory system uses this information to determine whether the sound source is in front of or behind the listener. The elevation of the source can be also determined from the spectral cues. Especially the frequency range above 4 kHz contains important information to distinguish between the up/down and front/back directions. Generation of all these cues is often combined in one filtering operation and these filters are called HRTF-filters (Head Related Transfer Function). The reproduction of the spatialized audio signal can be done either with headphones, two-loudspeaker system or multichannel loudspeaker system, for example. When headphone reproduction is used, problems often arise when the listener is trying to locate the signal in front/back and up/down positions. The reason for this is that when the sound source is located anywhere in the vertical plane intersecting the midpoint of the listener's head (median plane), the ILD and ITD values are the same and only spectral cues are left to determine the source position. If the signal has only little information on the frequency bands that the human auditory system uses to distinguish between front/back and up/down, then the location of the signal is very difficult.

The design and parameter selection of bandwidth expansion can affect the spatial processing block and vice versa, when the system and its properties are being optimized. Generally speaking, the more information there is above the 4 kHz frequency range, the better the spatial effect. On the other hand, overamplified higher frequencies can, for example, degrade the perceived speech quality as far as speech naturalness is concerned, whereas speech intelligibility as such may still improve. The properties of the bandwidth expansion block 20 can be taken into account when designing HRTF filters generally used to implement spectral and ILD cues. Some frequency bands can be amplified and others attenuated. These interrelations are not crucial but can be utilized when optimizing the invention.

There is also another interrelation between the bandwidth expansion 20 and the spatial processing 30. The HRTF filters that are preferably used for the spatial processing typically emphasize certain frequency bands and attenuate others. To enable real-time implementations these filters should preferably not be computationally too complex. This may set limitations on how well a certain filter frequency response is able to approximate peaks and valleys in the targeted HRTF. If it is known that the bandwidth expansion 20 boosts certain frequency bands, the limited amount of available poles and zeros can be used in other frequency bands, which results to a better total approximation, when the combined frequency response of the bandwidth expansion 20 and the spatial processing 30 is considered. Therefore, the bandwidth expansion 20 and the spatial processing 30 may be jointly optimized to reduce and re-distribute the total or partial processing load of the system, relating to e.g. the expansion 20 or the spatial processing 30. The bandwidth expansion 20 may, for example, shape the spectrum of the bandwidth expanded audio signal in such a way that it further enhances the spatial effect achieved with the HRTF filter of limited complexity. This approach is especially attractive when said spectrum shaping can be done by simple weighting, possibly simply by adjusting the weighting coefficients or other related parameters. If the existing bandwidth expansion process 20 already comprises some kind of frequency weighting, additional modifications necessary for supporting the specific requirements of the spatial processing 30 may be practically non-existent, or at least modest.

Additionally, aforementioned techniques can be applied in a multiprocessor system that runs the bandwidth expansion 20 in one processor and the spatial processing 30 in another, for example. The processing load of the spatial audio processor may be reduced by transferring computations to the bandwidth expansion processor and vice versa. Furthermore, it is possible to dynamically distribute and balance the overall load between the two processors for example according to the processing resources available for the bandwidth expansion 20 and/or spatial processing 30.

Figure 2:
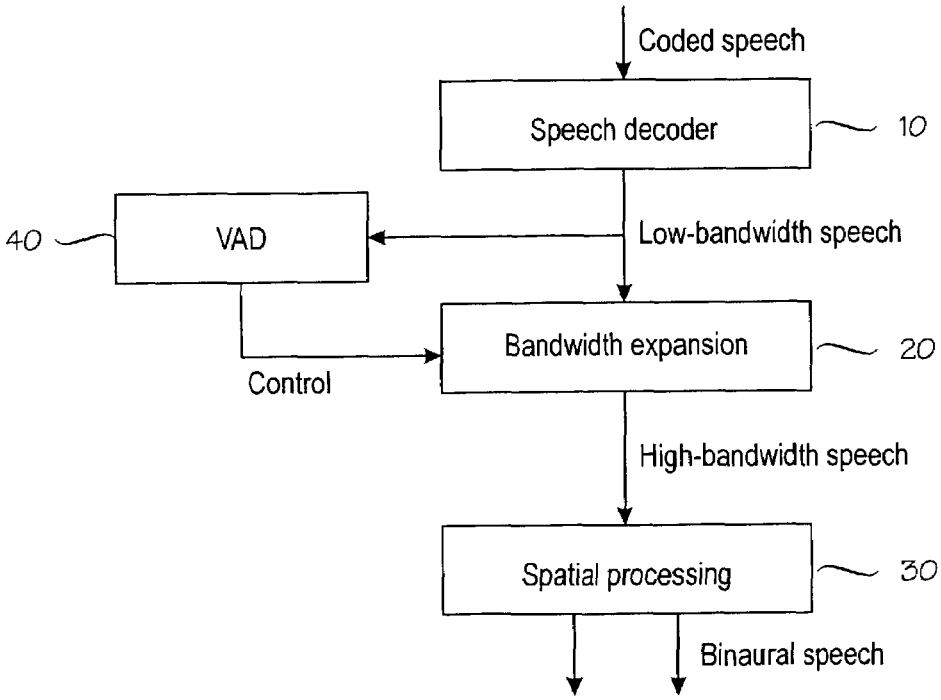
FIG. 2 is a block diagram of a signal processing arrangement according to an embodiment of the invention.

FIG. 2 illustrates a block diagram of a signal processing arrangement according to another embodiment of the invention. In the illustrated alternative embodiment, no control information is provided from the speech decoder 10 to the artificial bandwidth expansion block 20. Instead, the control information is provided by an additional voice activity detector (VAD) 40. It should be noted that the VAD block 40 can be integrated into the bandwidth expansion block 20 although in the figure it has been illustrated as a separate element. The system can also be implemented without any interrelations between the various processing blocks.

According to an embodiment of the invention the audio decoder 10 is a general audio decoder. In this embodiment of the invention the implementation of the bandwidth expansion block 20 can be different than what is described above. A possible application for this embodiment of the invention is an arrangement in which the coded audio signal is provided by a low-bandwidth music player, for instance.

It will be obvious to a person skilled in the art that, as the technology advances, the inventive concept can be implemented in various ways. The invention and its embodiments are not limited to the examples described above but may vary within the scope of the claims.

What is claimed is:

1. A method comprising:

receiving a speech signal having a narrow bandwidth;

identifying the received speech signal as voiced speech or unvoiced speech;

expanding the narrow bandwidth of the speech signal based on whether the received speech signal is voiced speech or unvoiced speech;

processing the speech signal having an expanded bandwidth for spatial reproduction; and jointly optimizing the performance of the expanding of the narrow bandwidth of the speech signal and the processing of the speech signal having the expanded bandwidth for spatial reproduction in relation to at least one property.

2. The method of claim 1, wherein the receiving the speech signal comprises:

receiving a coded speech signal having the narrow bandwidth; the method further comprising decoding the coded speech signal before expanding the narrow bandwidth of the coded speech signal.

3. The method of claim 1, wherein the expanding the narrow bandwidth of the signal comprises:

generating a frequency content signal having a frequency content outside a frequency band of the speech signal having the narrow bandwidth; and adding the frequency content signal to the speech signal having the narrow bandwidth to expand the speech signal.

4. The method of claim 1, wherein the processing the speech signal having an expanded bandwidth for spatial reproduction comprises:

filtering the speech signal having the expanded bandwidth with a head-related transfer function filter.

5. The method of claim 1, wherein the processing the speech signal having the expanded bandwidth for spatial reproduction comprises producing a stereophonic signal.

6. The method of claim 1, wherein the at least one property affects the spatial reproduction result.

7. The method of claim 1, wherein the at least one property affects a processing load required by the expanding of the narrow bandwidth of the speech signal and/or the processing of the speech signal having the expanded bandwidth.

8. The method of claim 1, wherein the optimizing comprises altering at least one parameter affecting the expanding of the narrow bandwidth of the speech signal and/or the processing of the speech signal having the expanded bandwidth.

9. The method of claim 1, further comprising dynamically distributing an overall processing load between the expanding of the narrow bandwidth of the speech signal and the processing of the speech signal having the expanded bandwidth.

10. A system comprising:

an identifier configured to identify a received speech signal as voiced speech or unvoiced speech;

an expander configured to expand a bandwidth of the speech signal based on whether the received speech signal is voiced speech or unvoiced speech; and a processor configured to process the speech signal having an expanded bandwidth for spatial reproduction, wherein the expander and the processor are jointly optimized in relation to at least one property.

11. The system of claim 10, the system further comprising:

a decoder configured to decode the speech signal before expanding the bandwidth of the speech signal.

12. The system of claim 11, wherein the decoder is configured to provide information to the expander.

13. The system of claim 10, further comprising:

a voice activity detector configured to provide control information to the expander.

14. The system of claim 10, wherein the expander further comprises:

a generator configured to generate a frequency content signal having frequency content that is outside a frequency band of the speech signal having a narrow bandwidth; and a combiner configured to combine the frequency content signal with the speech signal to expand the bandwidth of the speech signal.

15. The system of claim 10, wherein the processor is configured to produce a stereophonic signal.

16. The system of claim 10, wherein the processor comprises a head-related transfer function filter configured to filter the expanded bandwidth speech signal.

17. The system of claim 10, wherein the at least one property affects the spatial reproduction result.

18. The system of claim 10, wherein the at least one property affects a processing load of the expander and/or a processing load of the processor.

19. The system of claim 10, the system being configured to perform said optimization by altering at least one parameter of the expander and/or the processor.

20. The system of claim 10, the system being configured to dynamically distribute an overall processing load of the expander and the processor between said means.

21. An apparatus comprising:

a receiver configured to receive a speech signal;

an identifier configured to identify the received speech signal as voiced speech or unvoiced speech;

an expander configured to expand a bandwidth of the speech signal based on whether the received speech signal is voiced speech or unvoiced speech; and a processor configured to process the speech signal having an expanded bandwidth for spatial reproduction, wherein the expander and the processor are jointly optimized in relation to at least one property.

22. The apparatus of claim 21, further comprising:

a decoder configured to decode the speech signal received at the receiver.

23. The apparatus of claim 21, further comprising:

a generator configured to generate a frequency content signal, said frequency content signal having a frequency content outside a frequency band of the speech signal received at the receiver; and a combiner configured to combine the frequency content signal with the speech signal received at the receiver.

24. The apparatus of claim 21, further comprising:

a voice activity detector configured to provide control information to the expander.

25. The apparatus of claim 21, wherein the processor is configured to produce a stereophonic signal.

26. The apparatus of claim 21, wherein the processor comprises a head-related transfer function filter configured to filter the expanded bandwidth speech signal.

27. An apparatus comprising:

receiving means for receiving a speech signal;

identifying means for identifying the received speech signal as voiced speech or unvoiced speech;

expanding means for expanding a bandwidth of the speech signal based on whether the received speech signal is voiced speech or unvoiced speech; and processing means for processing the speech signal having an expanded bandwidth for spatial reproduction, wherein the expanding means and processing means are jointly optimized in relation to at least one property.

* * * * *